US007819205B2

(12) United States Patent
Többen

(10) Patent No.: US 7,819,205 B2
(45) Date of Patent: Oct. 26, 2010

(54) APPARATUS FOR THE COOLING OF DRILLING LIQUIDS

(75) Inventor: Bernardus Johannes Többen, Heerhugowaard (NL)

(73) Assignee: Task Environmental Services BV., Heerhugowaard (NL)

( * ) Notice: Subject to any disclaimer, the term of this patent is extended or adjusted under 35 U.S.C. 154(b) by 856 days.

(21) Appl. No.: 10/539,945

(22) PCT Filed: Dec. 17, 2003

(86) PCT No.: PCT/NL03/00902

§ 371 (c)(1),
(2), (4) Date: Jan. 17, 2006

(87) PCT Pub. No.: WO2004/055320

PCT Pub. Date: Jul. 1, 2004

(65) Prior Publication Data

US 2006/0131080 A1 Jun. 22, 2006

(30) Foreign Application Priority Data

Dec. 18, 2002 (NL) ..... 1022201

(51) Int. Cl.
*E21B 36/00* (2006.01)
*E21B 21/06* (2006.01)

(52) U.S. Cl. ..... 175/17; 175/66; 175/207

(58) Field of Classification Search ..... 175/66, 175/206, 207, 17
See application file for complete search history.

(56) References Cited

U.S. PATENT DOCUMENTS

| | | | | |
|---|---|---|---|---|
| 3,859,812 | A | 1/1975 | Pavlak | |
| 4,055,145 | A * | 10/1977 | Mager et al. | 119/212 |
| 4,215,753 | A | 8/1980 | Champness | |
| 4,836,123 | A * | 6/1989 | Grinde et al. | 114/382 |
| 4,913,245 | A * | 4/1990 | Skinner | 175/66 |
| 5,005,655 | A | 4/1991 | Williams et al. | |
| 5,107,874 | A | 4/1992 | Williams et al. | |
| 5,921,829 | A * | 7/1999 | Iwata | 440/88 R |
| 6,582,263 | B1 * | 6/2003 | Jaeger et al. | 440/89 C |

FOREIGN PATENT DOCUMENTS

| | | |
|---|---|---|
| CA | 1 170 998 B1 | 7/1984 |
| CA | 2 377 424 A | 9/2003 |

* cited by examiner

*Primary Examiner*—Giovanna C Wright
(74) *Attorney, Agent, or Firm*—Egbert Law Offices PLLC

(57) ABSTRACT

Method and apparatus for the cooling of drilling fluids (also referred to as mudcooler), includes use of two heat exchangers, wherein the drilling fluid (or warm drilling oil) is led through the first heat exchanger and is cooled by a mixture of glycol and water, while the glycol/water mixture is circulated in a closed circuit through a second heat exchanger, whereby the glycol/water mixture is cooled by seawater.

2 Claims, 4 Drawing Sheets

APPARATUS FOR THE COOLING OF DRILLING LIQUIDS

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The mud cooler is the offshore version of a series of world class drilling oil coolers that the applicant has developed for the oil-and gas industry.

BACKGROUND OF THE INVENTION

The mud cooler is the offshore version of a series of world class drilling oil coolers that the applicant has developed for the oil-and gas industry. Special about this drilling oil cooler is that the drilling oil does not come into contact with the ultimate cooling medium seawater. This is possible because use is made of two separate heat exchangers, which are built up of titanium cooling plates. In the first heat exchanger the drilling oil gives off its temperature to a mixture of water and glycol. In the second heat exchanger this mixture in its turn gives off its warmth to the seawater.

As an extra safety measure sensors are provided in the seawater outlet, which detect any possible oil leakage at once.

BRIEF SUMMARY OF THE INVENTION

Method and apparatus for the cooling of drilling fluids (also referred to as mudcooler), characterized in that use is made of two heat exchangers, wherein the drilling fluid (or warm drilling oil) is led through the first heat exchanger and is cooled by a mixture of glycol and water, while the glycol/water mixture is circulated in a closed circuit through a second heat exchanger, whereby the glycol/water mixture is cooled by seawater.

DETAILED DESCRIPTION OF THE INVENTION

Drilling Oil Cooler

The mud cooler is the offshore version of a series of world class drilling oil coolers that the applicant has developed for the oil-and gas industry. Special about this drilling oil cooler is that the drilling oil does not come into contact with the ultimate cooling medium seawater. This is possible because use is made of two separate heat exchangers 1 and 2, which are built up of titanium cooling plates. In the first heat exchanger 2 the drilling oil gives off its temperature to a mixture of water and glycol. In the second heat exchanger 1 this mixture in its turn gives off its warmth to the seawater.

As an extra safety measure sensors are provided in the seawater outlet, which detect any possible oil leakage at once.

The mud cooler MC 001 has the following advantages:

It is very suitable for the cooling of drilling oils at high pressure/high temperature (HP/HT) drillings;

It lengthens the lifespan of the drilling equipment;

It is environmentally friendly;

It improves working conditions;

It is doubly protected against oil leakages.

The mud cooler MC 001 is built in a . . . Ft container and weighs . . . Kg. The onshore units are provided with one heat exchanger with titanium plates and are cooled with air. The offshore units are provided with two heat exchangers 1 and 2 with titanium plates. In the first heat exchanger 2 the drilling oil is cooled with a mixture of water and glycol.

This mixture in its turn is cooled in the second heat exchanger 1 with seawater. By using two heat exchangers 1 and 2 it is prevented, in the case of a leakage, that oil from the drilling oil can end up directly in the sea. Further as an extra safety measure sensors are provided on the seawater outlet in order to be able to detect at once any possible oil leakages.

Usually the cooling starts when the temparature of the drilling oil is about 55 to 60 degrees Celsius, while it is always attempted to keep this below 80 degrees. Its is usual that the mixture, depending on the drilling depth, warms up ten to fifteen degrees during a circulation. More and more HT/HP (high temperature/high pressure) boreholes are drilled. It is neccesary to apply mudcoolers in order to improve the working conditions, to protect the environment and to prevent damages to the drilling equipment. The unit can play an important role in this.

Offshore drilling oil cooler.

The offshore drilling oil cooler or mud cooler is carried out with two plate type heat exchangers. The warm drilling oil is pumped through the first heat exchanger 2 and this is cooled by a mixture of glycol and water.

The mixture of glycol/water is circulated in a closed circuit through a second heat exchanger 1.

This mixture is cooled by seawater.

Figure 1:
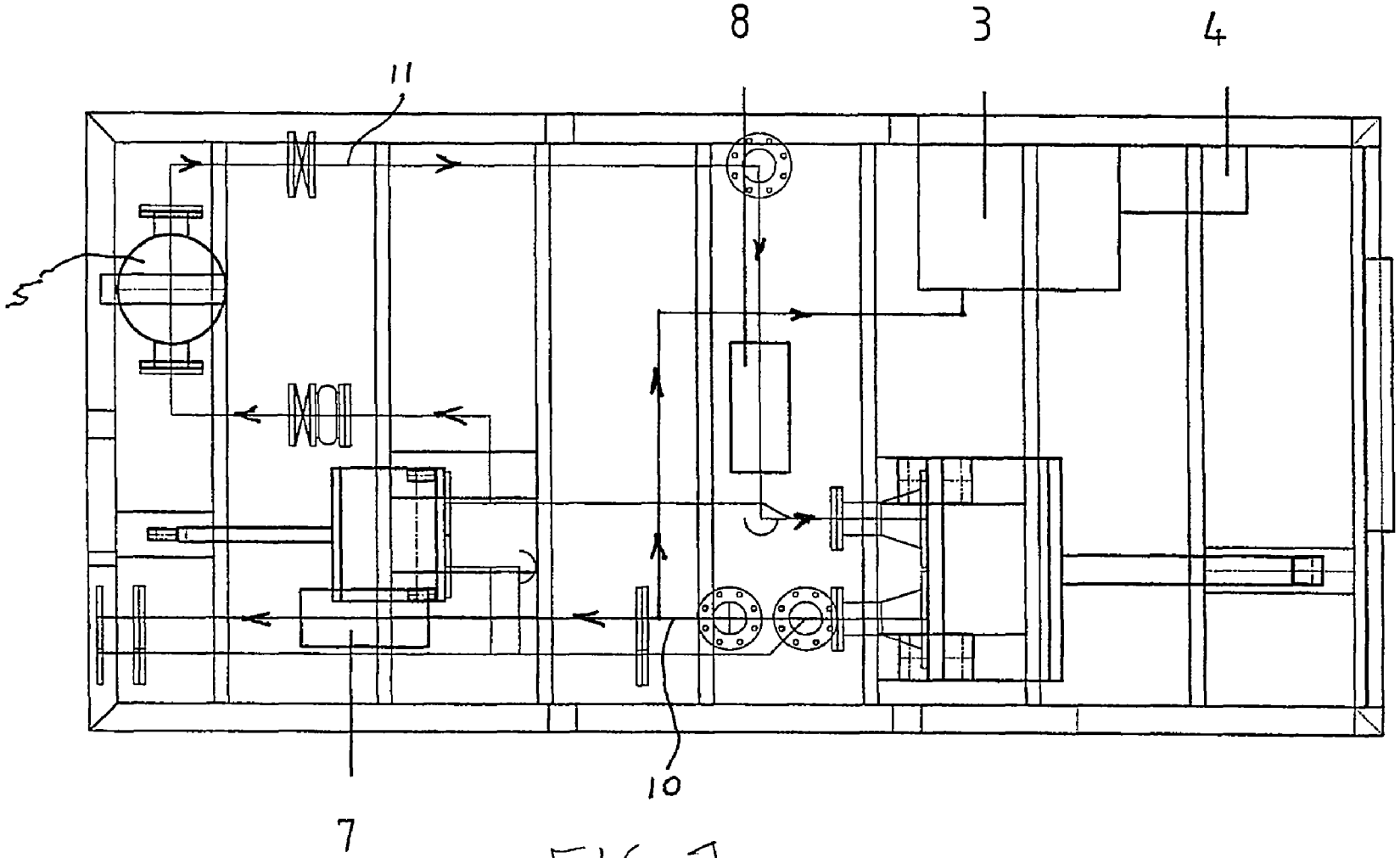
FIG. 1 is a top view of the embodiment of an apparatus for cooling drilling liquids according to the present invention.
Figure 2:
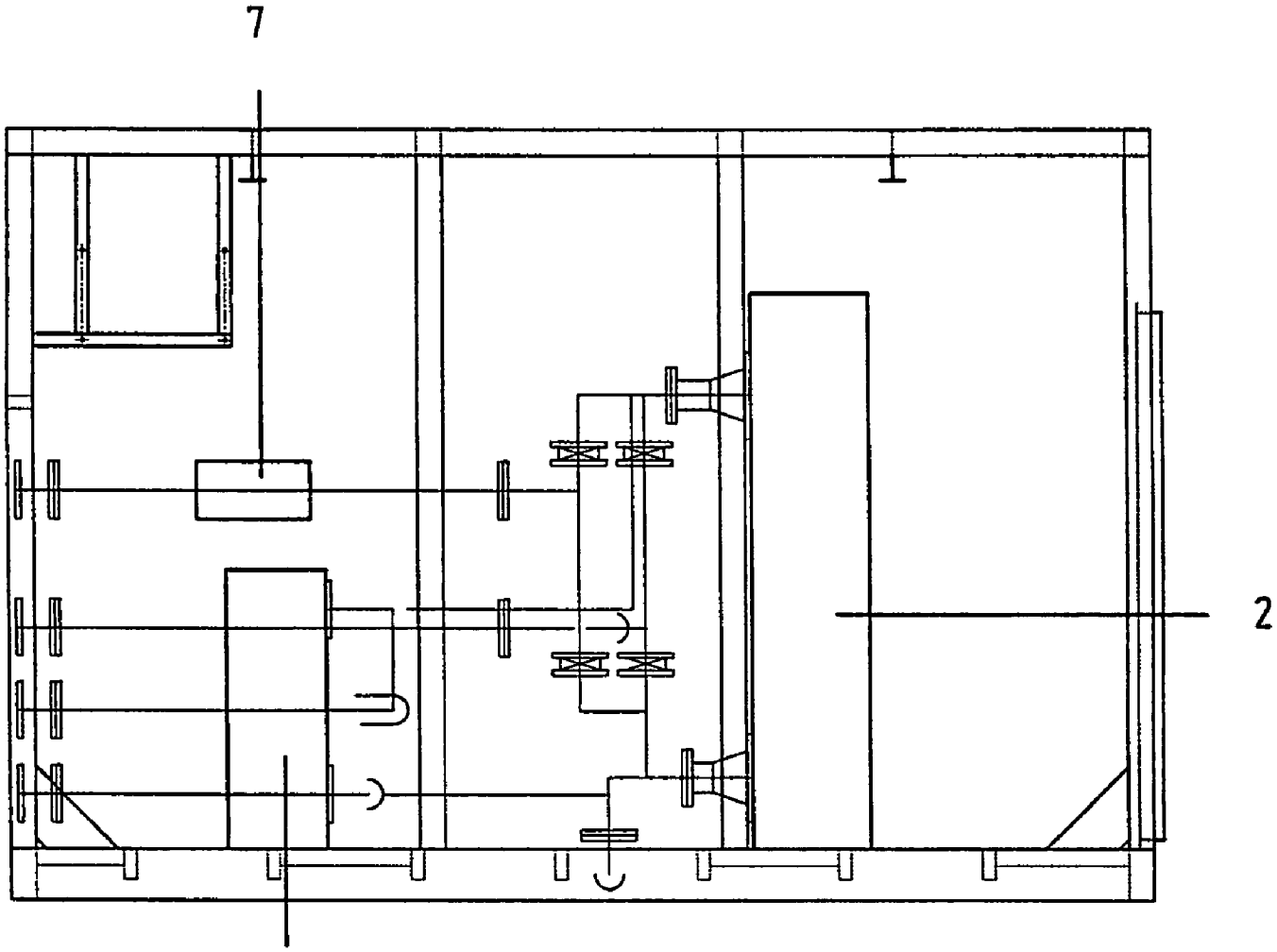
FIG. 2 is a side view of the embodiment of an apparatus for cooling drilling liquids according to the present invention shown in FIG. 1.
Figure 3:
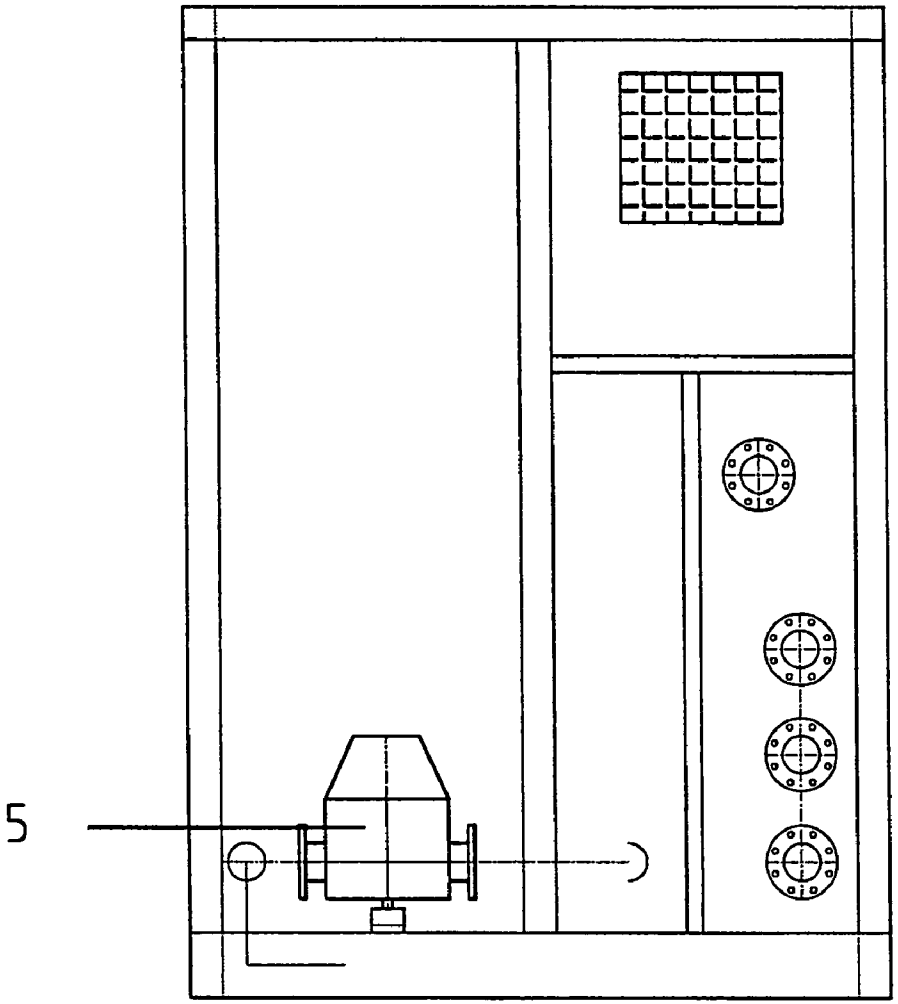
FIG. 3 is another side view of the embodiment of an apparatus for cooling drilling liquids according to the present invention shown in FIG. 1.
Figure 4:
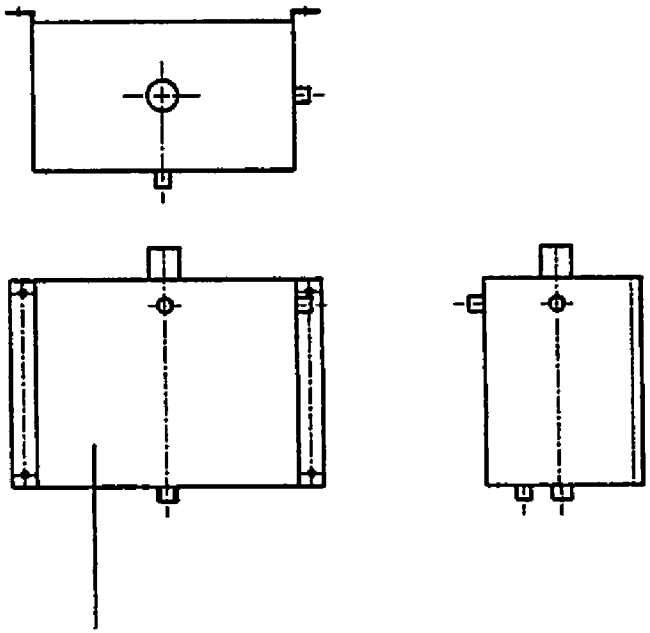
FIG. 4 shows a detailed view of an expansion tank used in the embodiment of the apparatus for cooling drilling liquids according to the present invention shown in FIG. 1.

As can be seen in FIG. 1, on the seawater return pipe 10, a sensor 3 is connected by sample line 9. Sensor 3 detects at once any possible oil leakages.

At the drilling oil side as well as at the glycol/water side, flowmeters 7 and 8 are connected by a closed circulation circuit 11.

These serve to control the cooling capacity and to detect any possible pollution of the plate packages.

At the drilling oil side of the first plate heat exchanger a manifold is provided in order to, in the case of contamination, turn the flow in order to flush back in this manner the contamination.

By using two heat exchangers 1 and 2, it is prevented in the case of leakage of the drilling oil cooler that oil ends up directly in the sea.

Technical specification "offshore mudcooler".

Heat exchanger mud/glycol cooler The plate type heat exchanger 2 is equipped with titanium plates and provided with EPDM clip on sealing.

The capacity of the heat exchanger is 2000 kW based on a flow of 750 lem mud with an inlet temperature of 85° C. and 2000 l/min ethylene glycol with an inlet temperature of 45° C. The fluid direction is countercurrent and the design pressure is 10 bar.

Heat exchanger glycol/seawater cooler 1.

The plate type heat exchanger 1 is equipped with titanium plates with EPDM clip on sealing. The capacity of the heat exchanger is 2000 kW based on a flow of 2000 lem ethylene glycol with an inlet temperature of 59° C. and an outlet temperature of 45° C. Seawater flow is based on 100 m3horizontal with an inlet temperature of 25° C.

The fluid direction is countercurrent and the design pressure is 10 bar.

Circulation pump.

The circulation pump 5 is used to pump the ethylene glycol mixture through the plate heat exchangers of mud and glycol cooler in a closed circuit system 11. One central expansion tank 6 of approx. 50 ltrs will be mounted on the highest level and will be delivered with a Murphy levelswitch/gauge. The expansion tank 6 is also provided a make-up line to the circulation pump 5.

The circulation pump 5 is of the vertical in-line type with a capacity of 2000 L/min at 16 mwc total head and is driven by a directly mounted explosion proof electric motor with an output of 7.5 kW at 400 V/50 Hz and 440 V/60 Hz. The arrows on the closed circuit system 11 in FIG. 1 illustrate how the circulation pump pumps the glycol mixture through the closed circuit system 11.

Starter Panel

The starter panel is explosion proof according to Cenclec standard EN 56014 and EN 50018, with all necessary starters and safety devices.

The unit is complete with a flow meter on the mud line 4 and an oil detector 3 mounted on the seawater return line.

The outside dimensions of the unit are:

| | | | |
|---|---|---|---|
| | | Length | 4500 mm |
| | | Width | 2150 mm |
| | | Height | 3000 mm |

| Item | Quantity | Filename | Remarks |
|---|---|---|---|
| 1 | 1 | SEAWATER/GLYCOWAT.COOLER | S1 INLET<br>S2 OUTLET<br>S3 INLET<br>S4 OUTLET |
| 2 | 1 | GLYCOLWATER/MUDCOOLER | S1 OUTLET<br>S2 INLET<br>S3 OUTLET<br>S4 INLET |
| 3 | 1 | OIL DETECTOR | |
| 4 | 1 | FLOWMETER | READING ITEM 7 AND 8 |
| 5 | 1 | PUMP | |
| 6 | 1 | EXPANSION TANK | |
| 7 | 1 | FLOWMETER | |
| 8 | 1 | FLOWMETER | |

I claim:

1. An apparatus for cooling drilling mud comprising:

a first heat exchanging means for passing the drilling mud in heat exchange relationship with a water and glycol mixture so as to cool the drilling mud;

a second heat exchanging means for passing the water and glycol mixture in heat exchange relationship with seawater;

a closed circuit between said first heat exchanging means and said second heat exchanging means, said closed circuit having the water and glycol mixture contained therein; and a pumping means for circulating the water and glycol mixture in said closed circuit, said second heat exchanging means comprising a seawater return pipe suitable for discharging seawater therefrom, said seawater return pipe having a sensor means cooperative therewith for detecting oil leakages.

2. The apparatus of claim 1, said first heat exchanging means comprising an inlet suitable for receiving warmed drilling mud therein, said first heat exchanging means comprising an outlet suitable for discharging cooled drilling mud, said inlet and said outlet being positioned at an oil drilling site in order to circulate the drilling mud thereof.

* * * * *